US006364190B1

(12) United States Patent
Tor

(10) Patent No.: US 6,364,190 B1
(45) Date of Patent: Apr. 2, 2002

(54) FASTENER DRIVING TOOL WITH TWIST ACTUATION

(75) Inventor: Sam Kao Tor, West Covina, CA (US)

(73) Assignee: Jamerco, Inc., City of Industry, CA (US)

( * ) Notice: Subject to any disclaimer, the term of this patent is extended or adjusted under 35 U.S.C. 154(b) by 0 days.

(21) Appl. No.: 09/488,048

(22) Filed: Jan. 20, 2000

(51) Int. Cl.[7] ..... B25C 1/14
(52) U.S. Cl. ..... 227/10
(58) Field of Search ..... 227/10, 9, 11, 227/8

(56) References Cited

U.S. PATENT DOCUMENTS 2,679,645 A * 6/1954 Erickson ..... 227/11
2,787,000 A * 4/1957 Smith et al. ..... 227/9
3,622,060 A * 11/1971 Gussalli ..... 227/10
3,918,619 A * 11/1975 Termet ..... 227/10
4,153,192 A * 5/1979 Jochum ..... 227/10
4,358,041 A * 11/1982 Olliver ..... 227/10
4,821,938 A * 4/1989 Haytayan ..... 227/10
5,310,108 A * 5/1994 Popovich et al. ..... 227/10
5,992,723 A * 11/1999 Lee ..... 227/9

* cited by examiner

*Primary Examiner*—Scott A. Smith
(74) *Attorney, Agent, or Firm*—Edgar W. Averill, Jr.

(57) ABSTRACT

A powder actuated tool for driving a fastener into a concrete steel or other hard surface. The tool has a main housing in which a barrel assembly is held. The barrel assembly is permitted to move in and out a short distance and is spring loaded in the out position. A cartridge is held at the inner end of the barrel. A piston is held within the barrel and has an upper end near the cartridge and a lower end adjacent a fastener to be driven. When the cartridge is detonated the piston is driven against the head of the fastener driving it into the concrete or other substrate. A firing pin is held in a breech block and is moved downwardly by contact with a firing hammer. The firing hammer is also held by the breech block and is spring loaded to move downwardly. Its downward movement is restrained by the contact of a tab resting on a ledge of the breech block. When the firing hammer is turned the tab falls into the slot causing the firing hammer to move downwardly and contact the firing pin thereby detonating the cartridge and driving the piston and eventually the fastener. The firing hammer is twisted by twisting the end handle of the tool.

23 Claims, 5 Drawing Sheets

FASTENER DRIVING TOOL WITH TWIST ACTUATION

BACKGROUND OF THE INVENTION

The field of the invention is powder actuated tools and the invention relates more particularly to powder actuated tools for driving a fastener into concrete or steel. While several products are on the market for explosively driving fasteners, they have commonly been actuated by striking the upper end of the tool with a hammer. For many fastener locations, because of a cramped location, it is sometimes difficult to strike the end of the tool with a hammer.

Several high velocity twist actuated tools have been developed, one of which is shown in U.S. Pat. No. 2,760,401. A tool is shown in U.S. Pat. No. 2,679,645 which discloses a high velocity stud driving tool activated by the discharge of a cartridge. The cartridge is fired by the impact of a spring loaded firing pin released by the turning of a grip handle 11. As the tool is compressed against a work piece, a trigger or latch 48 engages a notch 54 of control cam 13. As the handle is turned, the control can 13 disengages the latch 48, releasing the firing pin carrier.

Another high velocity twist activated tool is shown in U.S. Pat. No. 2,787,000. In this instance, a firing pin is held by a sear-type trigger 51. When the trigger is released, the firing pin moves downwardly and strikes the cartridge.

These tools have several potential safety hazards. First of all, when a loaded tool is dropped, the trigger can be inadvertently released, discharging the cartridge and firing the fastener. Furthermore, the tool fires the fastener by classic bullet technology. That is, the discharge of the cartridge provides gases which fire the fastener out of a barrel very much in the same way that a bullet is fired by a cartridge. The result is a fastener which travels at a very high rate of speed and can actually pass through a wall board and maintain enough velocity to cause serious injury to someone standing on the other side of the wall board.

BRIEF SUMMARY OF THE INVENTION

It is an object of the present invention to provide a low velocity powder actuated tool which is fired by twisting a handle and which cannot be fired by dropping.

DESCRIPTION OF THE PREFERRED EMBODIMENTS

Figures 1, 10A, 10B, 11:
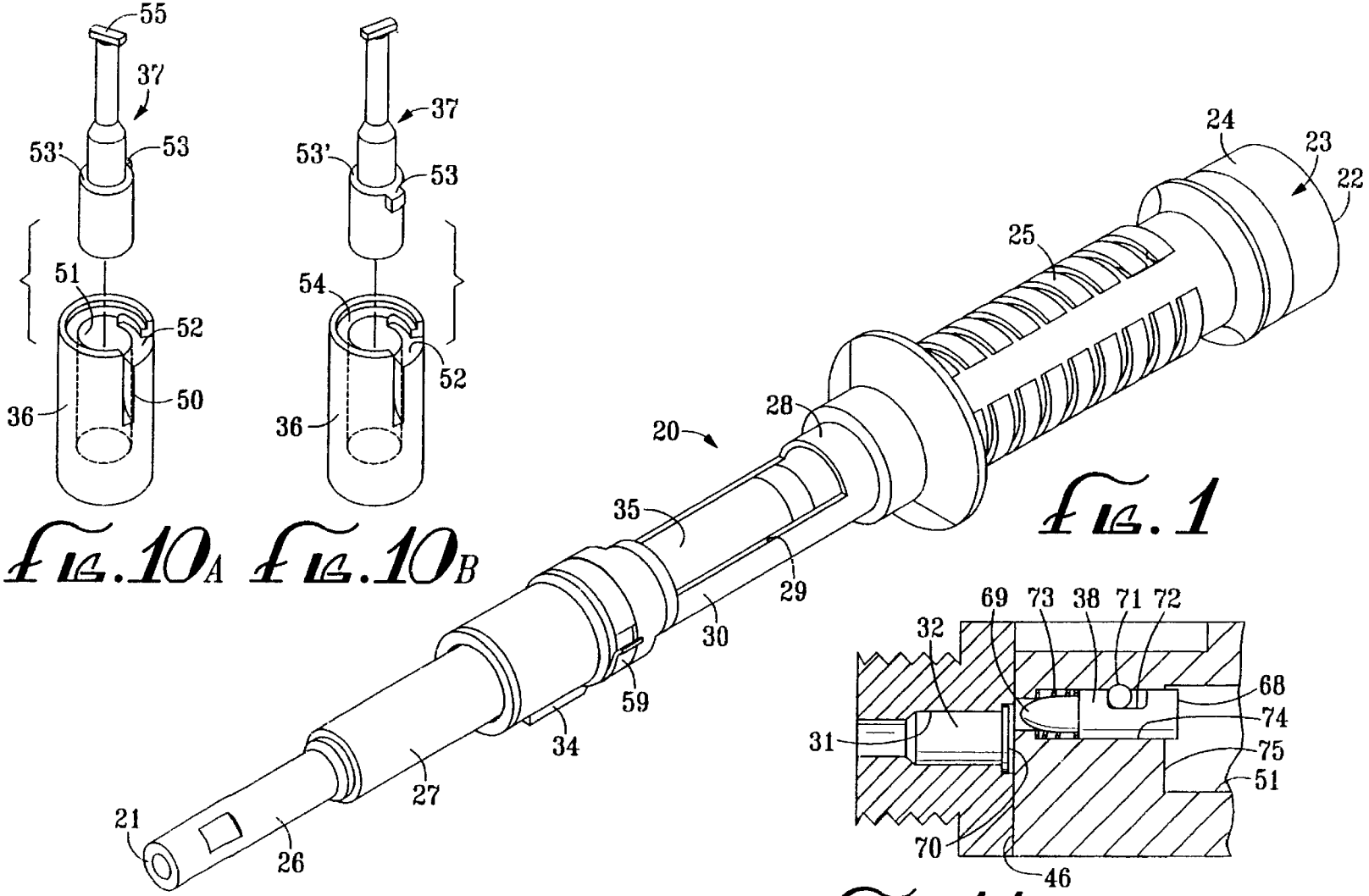
FIG. 1 is a perspective view of the powder actuated tool of the present invention.
FIG. 10A is an exploded side perspective view of the firing hammer and breech block of the powder actuated tool of FIG. 1, showing the firing hammer in a locked orientation.
FIG. 10B is an exploded side perspective view of the firing hammer and breech block of the powder actuated tool of FIG. 1, showing the firing hammer in a firing orientation.
FIG. 11 is an enlarged cross-sectional view showing the breech plug and a bottom portion of the breech block of the powder actuated tool of FIG. 1.

The powder actuated tool of the present invention is shown in perspective view in FIG. 1 and indicated generally by reference character 20. Tool 20 has a concrete or work piece contacting end 21. End 21 is placed against, for instance, a galvanized electrical box which is pressed against a concrete wall. When the fastener is fired, it passes through an opening in the electrical box and is driven into the concrete, thereby securely holding the electrical box to the concrete surface. Tool 20 also has a handle end 22 which includes a twistable handle 23 covered with cushioning rubber 24. A grippable handle 25 is made of rubber or other deflectable material so that the tool can be easily manipulated.

The tool is manipulated by placing the work piece contacting end 21 against a work piece and gripping the grippable handle 25 and pressing it with at least 10 lbs. of pressure against the work piece. This moves a fastener guide 26 and a barrel 27 inwardly into main housing 28. The operation of this compression will be discussed in further detail below.

Main housing 28 has a cartridge insertion opening 29 through a central passageway 30 thereof and an upper end 79. Barrel 27 may be pulled downwardly to a position shown in FIG. 3A where a cartridge 32 may be inserted into chamber 31 and breech plug 33.

Returning to FIG. 1, a piston reset pin 34 is held in main housing 28 by flat ring 59. Piston reset pin 34 limits the movement of both the barrel assembly and a piston 35.

Figure 2:
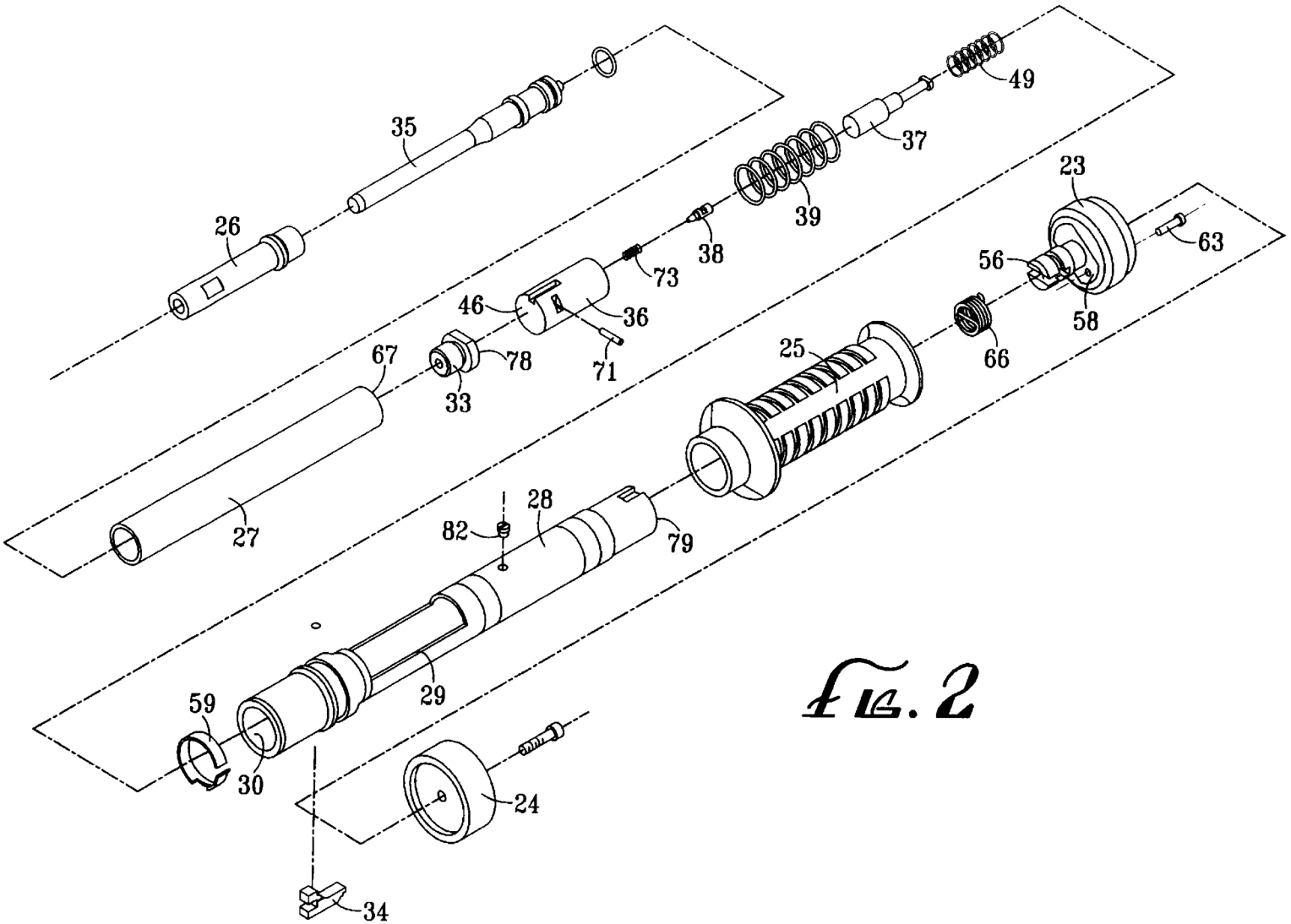
FIG. 2 is an exploded perspective view of the powder actuated tool of FIG. 1.
Figure 3A:
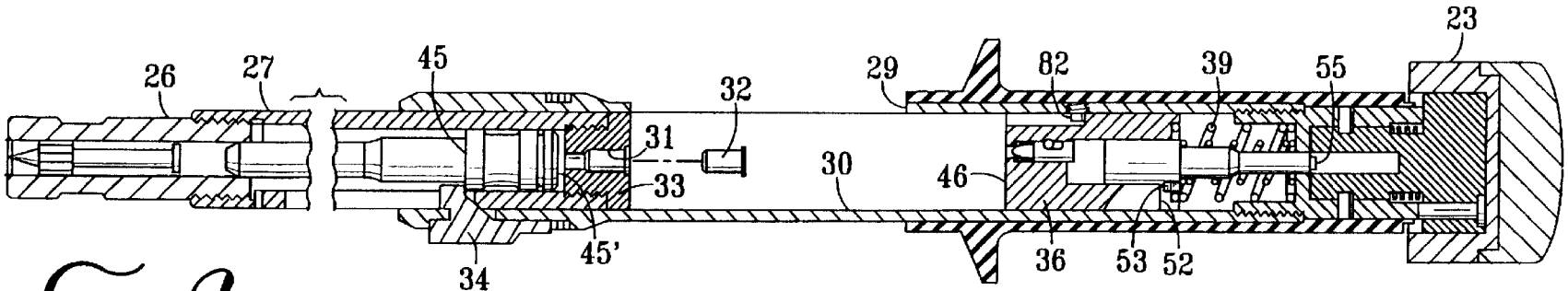
FIG. 3A is a cross-sectional view of the powder actuated tool of FIG. 1 in a cartridge loading position.
Figure 3B:
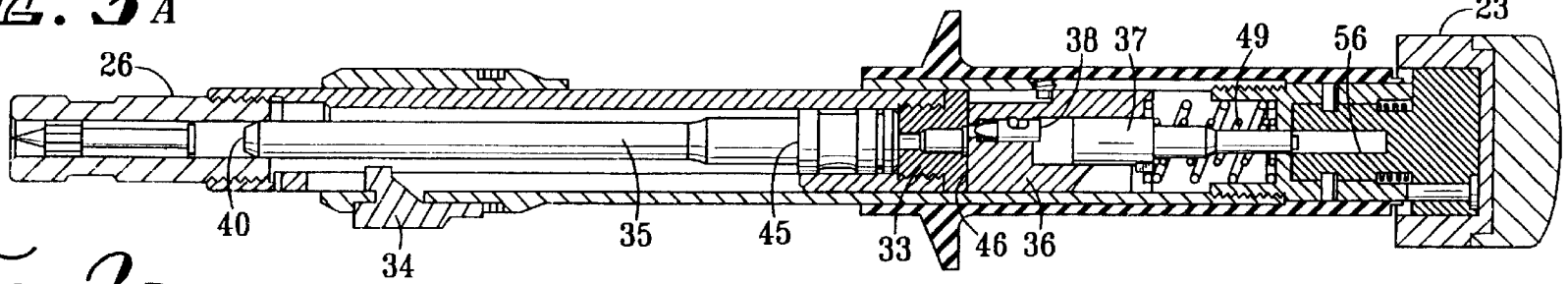
FIG. 3B is a cross-sectional view of the powder actuated tool of FIG. 1 in a loaded but not ready to fire configuration.

Described superficially, the powder actuated tool 20 is operated by placing a cartridge 32 in chamber 31 of breech plug 33 and moving the barrel assembly comprising the fastener guide 26, the barrel 27 and the breech plug 33 rearwardly to a position shown in FIG. 3B where breech plug 33 abuts a breech block 36. Barrel assembly 26, 27 and 33 has an upper end 67 which is also referred to as the cartridge end of the barrel assembly. Breech block 36 is shown in FIGS. 8A, 8B, 8C, 10A, 10B and partially in FIG. 11. Next, the work piece contacting end 21 is placed against the work piece to be fastened and pushed inwardly to compress breech block spring 39 and move the breech block upwardly to the position shown in FIG. 3C. Next, twistable handle 23 is twisted from its position shown in FIG. 3C to its position shown in FIG. 3D, thereby releasing a firing hammer 37 so that it contacts a firing pin 38 seen best by comparing FIGS. 3D and 3E. Firing hammer 37 is shown in FIGS. 7A, 7B, 10A, and 10B as well as in the exploded perspective view of FIG. 2.

Figure 3C:
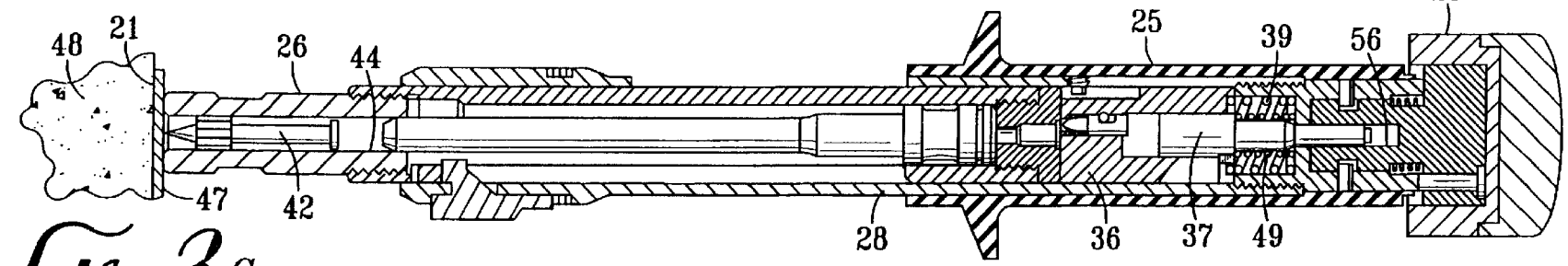
FIG. 3C is a cross-sectional view of the powder actuated tool of FIG. 1 in a loaded, compressed and ready to fire configuration.
Figure 3D:
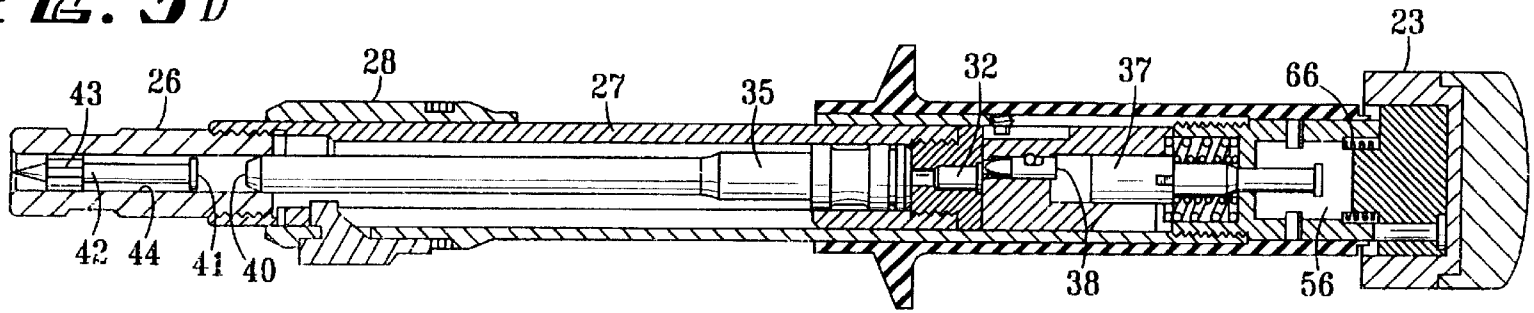
FIG. 3D is a cross-sectional view of the powder actuated tool of FIG. 1 in a ready to fire position with the handle turned to cause firing.
Figure 3E:
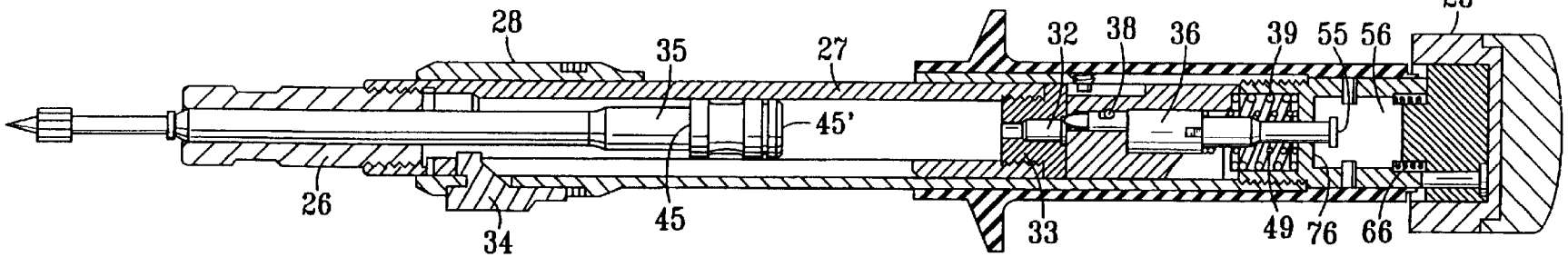
FIG. 3E is a cross-sectional view analogous to FIG. 3D, except showing the firing of the cartridge of the powder actuated tool of FIG. 1.

As shown in FIGS. 3D and 3E, piston 35, which is a captured piston, moves from an upper position shown in FIG. 3D to a lower position shown in FIG. 3E, caused by a detonation of cartridge 32. The expanding gases from the firing of cartridge 32 are pressed against upper end 45' of captured piston 35. At the same time, lower end or base 40 of piston 35 impacts the head 41 of fastener 42. Fastener 42 is positioned within bore 44 of fastener guide 26 and held in place by a conventional plastic flute 43. In this way the fastener itself is not shot like a bullet, but instead, is driven by captured piston 35. In this way the velocity of the fastener is much less than that produced by a free flight fastener. The fastener typically used with the tool of the present invention ranges from ½" to 3" in length. Because of the low velocity of the indirect driving of the fastener, it is not necessary to provide a safety shield on the tool such as that necessary when the fastener is directly driven by the gas of the firing cartridge.

Turning now to the various refinements of the powder actuated tool of the present invention, if one starts from a fired tool such as that shown in FIG. 3E, the captured piston 35 is in its lowermost position with respect to fastener guide 26. One then grasps the fastener guide 26 and pulls it outwardly with respect to main housing 28. As captured piston 35 moves downwardly with respect to main housing 28, a lower shelf 45 of piston 35 abuts piston reset pin 34, after which the piston, although moving within barrel 27, is stationary with respect to main housing 28 until upper end 39 of piston 35 abuts breech plug 33. This position is shown in FIG. 3A. The contact between piston reset pin 34, lower shelf 45, upper end 45' and breech plug 33 limits the outward movement of the barrel 27. The spent cartridge may be removed and a new cartridge 32 placed in chamber 31 as described above. Next, the barrel assembly, consisting of fastener guide 26, barrel 27 and breech plug 33, is pushed upwardly to the point where breech plug 33 contacts bottom surface 46 of breech block 36 as shown in FIG. 3B.

At the position shown in FIG. 3B, the breech block spring 39 is not significantly compressed. In order to fire the tool, after inserting the fastener 42 into the bore of fastener guide 26, the work piece contacting end 21 is pressed against a work piece, such as the metal tab of an electrical switch 47, which in turn is pressed against the surface of concrete 48. The grippable handle 25 is grasped and pressed toward concrete wall 48 with the pressure of about 10 lbs. This moves the barrel assembly (26, 27, 33) as well as breech block 36 and firing hammer 37, upwardly with respect to main housing 28. At this point it should be noted that firing hammer 37 is biased by firing spring 49 which is also compressed by this inward movement.

Figure 9A:
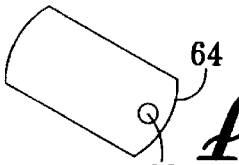
FIG. 9A is a top view of an inner portion of the release block of the powder actuated tool of FIG. 1.
Figure 9B:
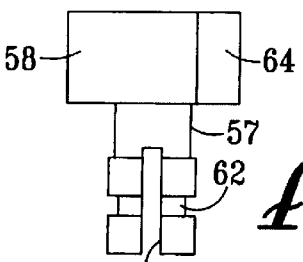
FIG. 9B is a side view of the inner portion of the release block of the powder actuated tool of FIG. 1.
Figure 9C:
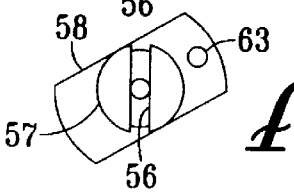
FIG. 9C is a bottom view of the interior portion of the release block of the powder actuated tool of FIG. 1.
Figure 5:
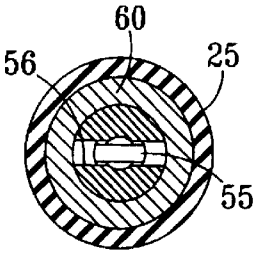
FIG. 5 is a cross-sectional view taken along line 5—5 of FIG. 4.

The details of the movement of the firing pin are best understood by viewing FIGS. 10A and 10B. In FIG. 10A, it can be seen that breech block 36 has a slot 50 in one side of the wall between central guide opening 51 and the outer surface of breech block 36. At the top of slot 50 is a slot ledge 52. Slot ledge 52 supports a tab 53 on firing hammer 37. A recessed spring base 54 provides a bottom support for breech block spring 39. Also, an annular shelf 53' provides a bottom support for firing spring 49. A graspable extension 55 is positioned at the upper end of firing hammer 37 and mates with a centrally and axially aligned slot 56 in cylindrical shaft 57 of the inner portion 58 of twistable handle 23. This inner portion 58 is shown best in FIGS. 9A, 9B and 9C. Slot 56 provides a downwardly depending interlocking member which is captured in a handle supporting cup 60 shown best in FIG. 4 of the drawings and which forms the uppermost end of main housing 28. A pair of pins 61 secure the cylindrical shaft 57 by extending into a recess 62 thereon. This permits the turning of cylindrical shaft 57 and, thus, the turning of the centrally and axially aligned slot 56. A pin 63 extends downwardly from the handle portion 64 of inner portion 58. Pin 63 rides in an arcuate slot 65 at the upper surface of handle supporting cup 60. This limits the turning arc of twistable handle 23 to an arc of about 45°.

Figure 4:
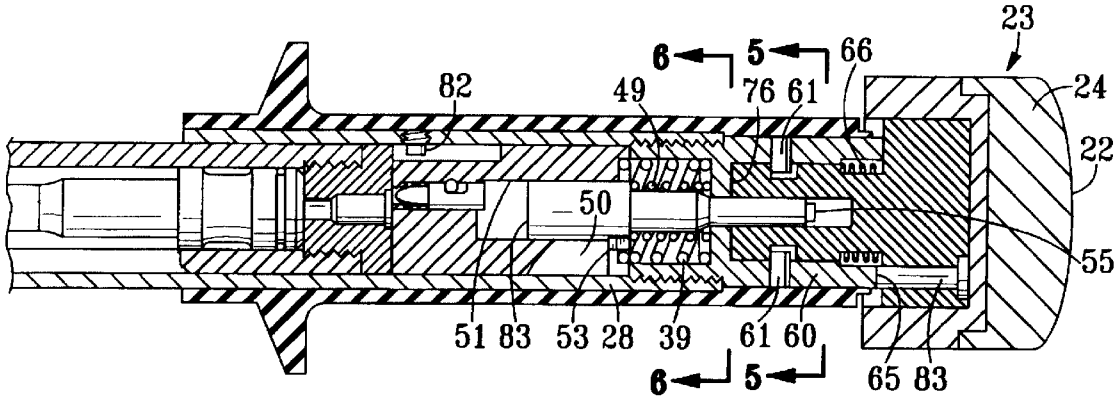
FIG. 4 is an enlarged cross-sectional view of the upper end of the tool as shown in FIG. 3C.

As also shown best in FIG. 4, and also in FIG. 2, a release spring 66 biases twistable handle 23 in a counter clockwise manner. Thus, to fire the tool, the twistable handle 23 is rotated clockwise a distance of about 45°.

As twistable handle 23 is rotated in a clockwise position after the barrel assembly has been compressed, as shown in FIG. 3C, the slot 56 of the handle assembly, including cylindrical shaft 57, turns. The graspable extension 55 of firing hammer 37 thus causes firing hammer 37 to twist. Tab 53 then rides along the upper surface of slot ledge 52 until it reaches slot 50. At this point, firing hammer 37 falls into central guide opening 51 of breech block 36 caused by the spring action (or recoil) of the compressed firing spring 49. This results in the face 83 of firing hammer 37 striking the head 68 (see FIG. 11) of firing pin 38. This causes the point 69 to strike the rim 70 of cartridge 32, thereby igniting the cap. It should also be noted that rim 70 is recessed in breech plug 33 to further reduce the chance of inadvertent firing of the tool.

As shown in FIG. 11, firing pin 38 is captured by a pin 71 which rides in slot 72 of firing pin 38. Firing pin 38 is also biased upwardly by firing pin spring 73. Pin 71 extends into firing pin passageway 74 and permits the head to extend above the closed bottom 75 of central guide opening 51.

Figure 6:
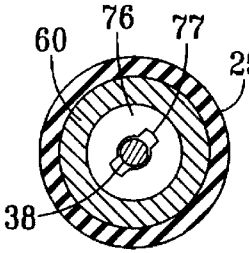
FIG. 6 is a cross-sectional view taken along 6—6 of FIG. 4.
Figure 8A:
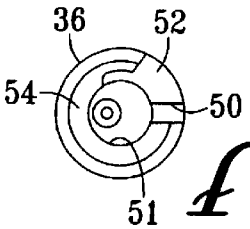
FIG. 8A is a top view of the breech block of the powder actuated tool of FIG. 1.
Figure 7A:
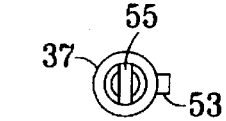
FIG. 7A is a top view of the firing hammer of the powder actuated tool of FIG. 1.
Figure 8C:
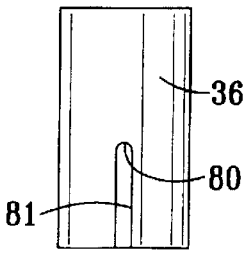
FIG. 8C is a side view of the breech block of FIG. 8A.
Figure 8B:
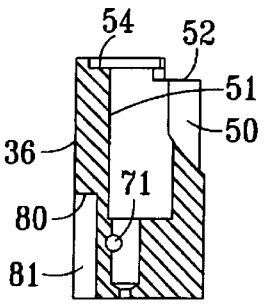
FIG. 8B is a cross-sectional side view of the breech block of FIG. 8A.
Figure 7B:
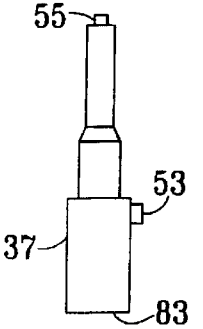
FIG. 7B is a side view of the firing hammer of the powder actuated tool of FIG. 1.

The procedure for resetting firing hammer 37 involves the interaction of graspable extension 55 and the floor 76 of handle supporting cup 60. This main housing upper floor 76 is shown in FIG. 6 and can be seen to have a slotted opening 77 through which graspable extension 55 may pass. However, once graspable extension 55 is turned through a small arc, it is then held by floor 76. Thus, when the tool moves from its position in FIG. 3E where breech block spring 39 is compressed to its position shown in FIG. 3A where the breech block spring 39 is released, the graspable extension 55 abuts the main housing upper floor 76 and has the effect of drawing the breech block downwardly while the firing hammer 37 moves out of central guide opening 51. When tab 53 extends completely out of slot 50, the biased force caused by reset spring 66 twists firing hammer 37 so that tab 53 is moved over slot ledge 52. Then as the breech block 39 is released as shown in FIG. 3A, the firing hammer has twisted to be oriented over slot ledge 52. Then as the breech block spring 39 is compressed by pressing work piece contacting end 22 against a work piece as shown in FIG. 3C, the firing hammer 37 is retained in an upper position as shown in FIG. 3C. Next, the handle 23 is twisted so that its associated slot 56 grasps the graspable extension 55, thereby turning firing hammer 37 and aligning tab 53 with slot 50, causing the cartridge to fire as described above.

Not only does the turning of handle 23 turn firing hammer 37 through its graspable extension 55, but also, the graspable extension 55 restrains the handle because tab 53 is captured in slot 50. Thus, as the tool is compressed against a work piece as shown in FIG. 3C, at the point where tab 53 rises about slot 50, it actually permits handle 23 to twist back to its ready-to-fire position under the force of reset spring 66.

One additional feature is required which is a means for limiting the downward movement of breech block 36. This downward movement is limited by the contact between an upper end 80 of slot 81 (see FIG. 8C) with a positioning screw 82 shown, for instance, in FIG. 3A.

The tool of the present invention has been described in the claims as if it were vertically oriented, such as when driving a nail into a concrete floor. It is, of course, to be understood that the tool will operate in any orientation, including, of course, horizontal or straight up. The downward orientation language is used in the claims to help assist in describing the interrelationship of the parts without limiting the particular orientation in which the tool may be used.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A powder actuated tool (20) for driving a fastener (42) comprising:

a main housing (28) having an upper end, a lower end (21), a central passageway (30) and an opening passing through said main housing (28) to said central passageway (30);

a barrel (27) held within said central passageway (30), said barrel (27) having a cartridge end, a muzzle end (21) and a central bore;

a breech plug (33) at the cartridge end of said barrel (27), said breech plug (33) having an upper surface, a cartridge chamber (31) extending downwardly from said upper surface and extending into the central bore of said barrel (27);

a fastener guide (26) adjacent said muzzle end of said barrel (27), said fastener guide (26) having a work piece-contacting end (21) and an upper end adjacent the muzzle end of said barrel (27), said fastener guide (26) and said barrel (27) being longitudinally movable within said central passageway (30) of said main housing (28);

a firing pin (38) movable between a retracted position and a extended-firing position, said firing pin (38) being held within said main housing (28);

a twistable handle (23) held adjacent said upper end of said main housing (28), said twistable handle (23) being mounted so that it may be twisted with respect to said main housing (28) from a first position to a second position; and means for moving said firing pin (38) from its retracted position to its extended-firing position in response to twisting said twistable handle (23) from its first position to its second position whereby when a cartridge (32) has been placed in said cartridge chamber (31) and has been contacted by said firing pin (38), the resulting detonation of said cartridge (32) drives a fastener (42) in said fastener guide (26) into a work piece (47).

2. The powder actuated tool (20) of claim 1 wherein said twistable handle (23) is biased toward its first position.

3. The powder actuated tool (20) of claim 1 wherein said fastener guide (26), said barrel (27), and said breech plug (33) are longitudinally movable in said main housing (28) and are biased downwardly with respect to said main housing (28).

4. The powder actuated tool (20) of claim 3 wherein said fastener guide (26), said barrel (27) and said breech plug (33) are biased downwardly by a breech block spring (39) having an upper end and a lower end and supported by said main housing (28) at said upper end and by a breech block (36) at its lower end.

5. The powder actuated tool (20) of claim 4 further including a breech block (36), said breech block (36) having a longitudinal opening (51) which supports said firing pin (38) and said breech block (36) also supporting a firing hammer (37).

6. The powder actuated tool (20) of claim 5 wherein said firing hammer (37) has a tab (53) and said breech block (36) has a slot (50) and a ledge (52) adjacent an upper end of said longitudinal opening (51) in said breech block (36) and wherein said firing hammer (37) is biased downwardly.

7. The powder actuated tool (20) of claim 6 wherein said firing hammer (37) is biased downwardly by a helical firing spring (49) and wherein said breech block spring (39) is a helical spring and wherein said breech block spring (39) and said firing spring (49) are co-axially mounted within said main housing (28).

8. The powder actuated tool (20) of claim 1 wherein a captured piston (35) is held within said barrel (27), said captured piston (35) having an upper end (45') movable to a position adjacent said breech plug (33) prior to detonation of a cartridge (32) and movable to a fired position where a base (40) thereof is adjacent said work piece contacting end (21) of said fastener guide (26) whereby said fastener (42) is moved by the movement of the captured piston (35) rather than by expanding gasses of a detonated cartridge (32).

9. A powder activated tool for driving a fastener (42) comprising:

a main housing (28) having an upper end, a lower end (21), a central passageway (30), and an opening passing through said main housing (28) to said central passageway (30);

a barrel assembly (26, 27, 33) including means for supporting a cartridge (32) at a cartridge end thereof said means for supporting a cartridge (32) including a cartridge chamber (31) and means for supporting a fastener (42) at a fastener end thereof, said barrel assembly (26, 27, 33) being held at least partially in the central passageway (30) of the main housing (28);

a breech block (36) supported in said main housing (28) above said barrel assembly (26, 27, 33), said breech block (36) having a central guide opening (51) including a guide opening side and a guide opening top;

a firing hammer (37) slidably supported in said central guide opening (51) of said breech block (36) above said cartridge (32), and said firing hammer (37) and said breech block having at least one mating slot, slot ledge and tab and said firing hammer (37) being biased downwardly;

means for lifting said firing hammer (37) in said breech block (36);

means for turning one of said breech block (36) and said hammer with respect to one another so that the tab rests on said slot ledge; and means for turning one of said breech block (36) and said hammer with respect to the other of said breech block

(36) and said hammer so that the tab moves along the slot ledge and enters into said slot, whereby the hammer moves downwardly and initiates means to detonate a cartridge (32) in said cartridge chamber (31).

10. The powder actuated tool (20) of claim 9 wherein said means for supporting a cartridge (32) is a breech plug (33) affixed at an upper end of said barrel assembly (26, 27, 33), said breech plug (33) having a flat upper surface having an axially aligned cartridge chamber (31) including a rim recess so that when a cartridge (32) is inserted in said cartridge chamber (31) the cartridge (32) is entirely positioned below said flat upper surface.

11. The powder actuated tool (20) of claim 10 wherein said means for supporting a fastener (42) comprises a fastener guide (26) axially affixed to a lower end of said barrel assembly (26, 27, 33), said fastener guide (26) having a central bore (44) into which a fastener (42) is inserted and said fastener guide (26) having a work piece-contacting lower end (21).

12. The powder actuated tool (20) of claim 11 wherein a captured piston (35) is slidably held within said barrel assembly (26, 27, 33), said captured piston (35) having an upper end (45) movable to an upper position adjacent said breech plug (33) and a lower fastener-contacting end (40) movable downwardly to a lower position adjacent said work piece-contacting lower end (21).

13. The powder actuated tool (20) of claim 12 wherein said barrel assembly (26, 27, 33) is vertically movable in said main housing (28) and occupies at least three stopped positions, an uppermost position wherein said fastener-contacting end (21) is pressed against a work piece (47) and a breech block spring (39) is compressed, a middle position wherein said fastener contacting end (21) is not being pressed downwardly and said breech block spring (39) is expanded, and a lowermost position wherein said breech plug (33) is lowered in said main housing (28) adjacent said opening of said main housing (28) to permit a user to remove a spent cartridge (32) and insert a fresh cartridge (32).

14. The powder actuated tool (20) of claim 9 wherein said barrel assembly (26, 27, 33) is vertically movable in said main housing (28) and occupies at least two stopped positions namely an upper position ready for firing wherein a barrel spring assembly (39, 49) is compressed between a top surface of said central passageway (30) of said main housing (28) and an upper portion of said breech block (36) and a lower position wherein said breech block (36) and said barrel assembly (26, 27, 33) have been pressed downwardly by the biasing action of said barrel spring assembly (39, 49) and wherein said firing hammer (37) is contacted by a lower end of said barrel spring assembly (39, 49) which barrel spring assembly (39, 49) is compressed when said barrel assembly (26, 27, 33) is in said upper position.

15. The powder actuated tool (20) of claim 14 wherein a twistable handle (23) is captured in said upper end of said main housing (28) and said twistable handle (23) is limited in rotational movement to an actuating arc which at one end of the actuating arc the twistable handle (23) is in a ready position and at an other end of said actuating arc is in a fired position and wherein said twistable handle (23) is biased toward said ready position.

16. The powder actuated tool (20) of claim 15 wherein said barrel spring assembly (39, 49) comprises a breech block spring (39) which does not contact said firing hammer (37) but only said breech block (36) and a firing spring (49) which does not directly contact said breech block (36) but only said firing hammer (37).

17. The powder actuated tool (20) of claim 16 wherein said central guide opening (51) of said breech block (36) has a closed bottom (75) and wherein a firing pin passageway (74) passes from said closed bottom (75) of said central guide opening (51) to a lower base of said breech block (36) and wherein a firing pin (38) is captured in said firing pin passageway (74) and wherein said firing pin (38) has an upper contact end (68) and wherein said firing pin (38) is biased upwardly wherein its upper contact surface (68) is above said closed bottom (75) of said firing pin passageway (74) and is moved downwardly by impact with said firing hammer (37).

18. A powder activated tool for driving a fastener (42) comprising:

a main housing (28) having an upper end, a lower end, a central passageway (30), an outer surface;

a barrel assembly (26, 27, 33) including means for supporting a cartridge (32) at a cartridge end thereof said means for supporting a cartridge (32) including a cartridge chamber (31) and said barrel assembly (26, 27, 33) having means for supporting a fastener (42) at a fastener end thereof, said barrel assembly (26, 27, 33) being held at least partially in the central passageway (30) of the main housing (28);

a breech block (36) supported in said main housing (28) above said barrel assembly (26, 27, 33), said breech block (36) having a central guide opening (51) including a guide opening side and a guide opening top;

a firing hammer (37) slidably supported in said central guide opening (51) of said breech block (36) above said cartridge (32) and said firing hammer (37) and said breech block (36) having at least one mating slot (50), slot ledge (52) and tab (53) and said firing hammer (37) being biased downwardly;

means for lifting said firing hammer (37) in said breech block (36);

means for turning said firing hammer (37) with respect to said breech block (36) so that the tab (53) rests on said slot ledge (52); and means for turning said firing hammer (37) with respect to said breech block (36) so that the tab (53) moves along the slot ledge (52) and enters into said slot (50), the hammer (37) moves downwardly into said central guide opening (51) in said breech block (36) and initiates means to detonate a cartridge (32) in said cartridge chamber (31).

19. The powder actuated tool (20) of claim 18 wherein said firing hammer (37) has a graspable extension (55) and wherein said means for turning said firing hammer (37) comprises a twistable handle (23) captured in the upper end of said main housing (28), said twistable handle (23) including a downwardly depending interlocking member (56) which is shaped to interlock with said graspable extension (55) of said firing hammer (37) whereby when said twistable handle (23) is turned, said firing hammer (37) turns.

20. The powder actuated tool (20) of claim 19 wherein said means for lifting said firing hammer (37) in said breech block (36) comprises a main housing upper floor (76) formed on said upper end of said main housing (28) and said graspable extension (55) being shaped so that it contacts said main housing upper floor (76) as said main housing upper floor (76) moves away from said breech block (36).

21. The powder actuated tool (20) of claim 20 wherein said graspable extension (55) is a generally rectangular head (55) affixed at an upper end of said firing hammer (37) and said main housing upper floor (76) has a generally rectangular opening (77) larger than said generally rectangular head (55) but small enough to hold said generally rectangular head (55) when it is not aligned with said generally rectangular opening (77) and means for moving said breech block (36) away from said main housing upper floor whereby said firing hammer (37) is lifted in said breech block (36) as said breech block (36) is moved away from said upper floor (76).

22. The powder actuated tool (20) of claim 21 wherein said downwardly depending interlocking member (56) comprises a cylindrical shaft (57) having a centrally and axially aligned slot (56) which is shaped to permit said generally rectangular head (55) to move axially therein but will prevent said generally rectangular head (55) to turn in said slot (56).

23. The powder actuated tool (20) of claim 22 wherein said breech block (36) has a slot (81) and said main housing (28) has a pin (82) which extends into said slot (81) which limits the downward movement of said breech block (36).

* * * * *